United States Patent [19]

Holland et al.

[11] Patent Number: 4,570,821

[45] Date of Patent: Feb. 18, 1986

[54] ARTICLE-DISPENSING ASSEMBLY FOR A VENDING MACHINE

[75] Inventors: Charlie R. Holland, St. Louis; Michael J. DelPercio, Fenton, both of Mo.

[73] Assignee: Coin Acceptors, Inc., St. Louis, Mo.

[21] Appl. No.: 451,454

[22] Filed: Dec. 20, 1982

[51] Int. Cl.[4] ..... B65H 3/00

[52] U.S. Cl. ..... 221/194; 221/251; 221/263; 221/289

[58] Field of Search ..... 221/191, 194, 245, 251, 221/255, 256, 263, 266, 289

[56] References Cited

U.S. PATENT DOCUMENTS

| | | | |
|---|---|---|---|
| 772,226 | 10/1904 | Disbrow | 221/245 |
| 1,113,476 | 10/1914 | Osmer | 221/194 X |
| 2,150,469 | 3/1939 | Tozer et al. | 221/194 X |
| 2,274,065 | 2/1942 | Hull et al. | 221/266 X |
| 2,299,835 | 10/1942 | Mayer | 221/251 X |
| 2,521,458 | 9/1950 | Huheey et al. | 221/125 |
| 3,190,493 | 6/1965 | Johnson et al. | 221/194 X |

*Primary Examiner*—Joseph J. Rolla
*Assistant Examiner*—Michael S. Huppert
*Attorney, Agent, or Firm*—Cohn, Powell & Hind

[57] ABSTRACT

An article-dispensing assembly including a door movably mounted on a plate for selectively opening and closing an opening provided in the plate, the door including a shelf extending inwardly of the opening and providing a bin for holding an article to be dispensed. A control mechanism is movable to a first position to allow transfer of an article from a feed mechanism to the bin, and movable to a second position to block transfer of an article from the feed unit to the bin. An operating unit selectively interconnects the control unit and door to allow loading of the bin when the door is in its closed position and to preclude loading of the bin when the door is moved from the closed position.

19 Claims, 8 Drawing Figures

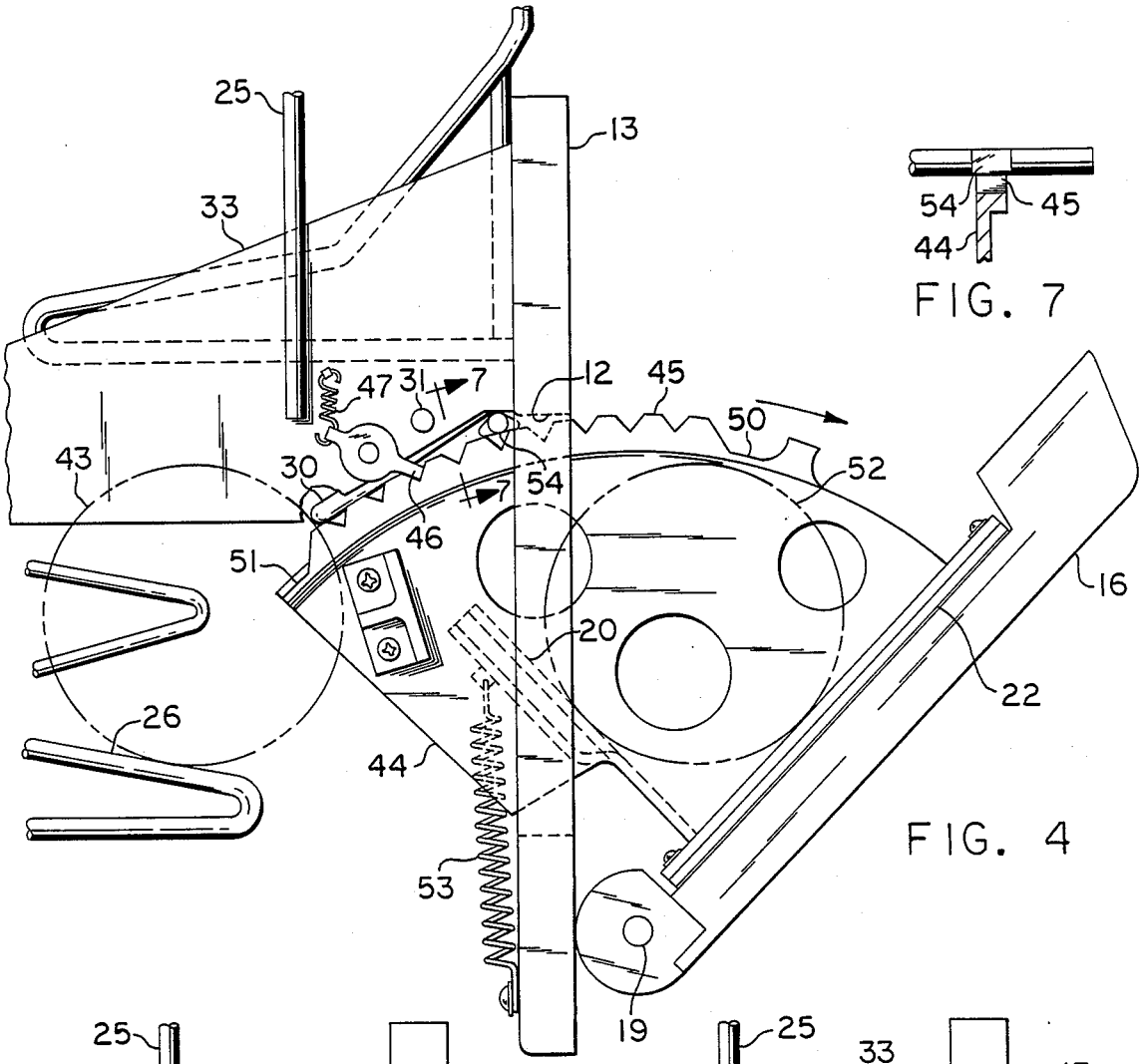
FIG. 4
FIG. 7
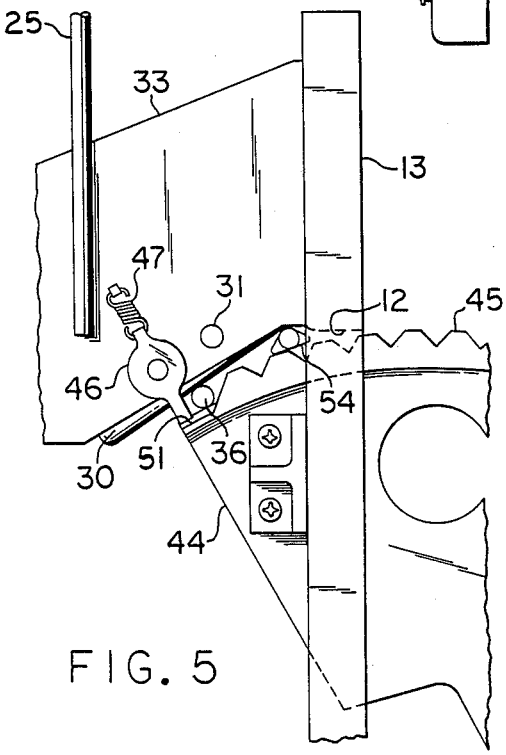
FIG. 5
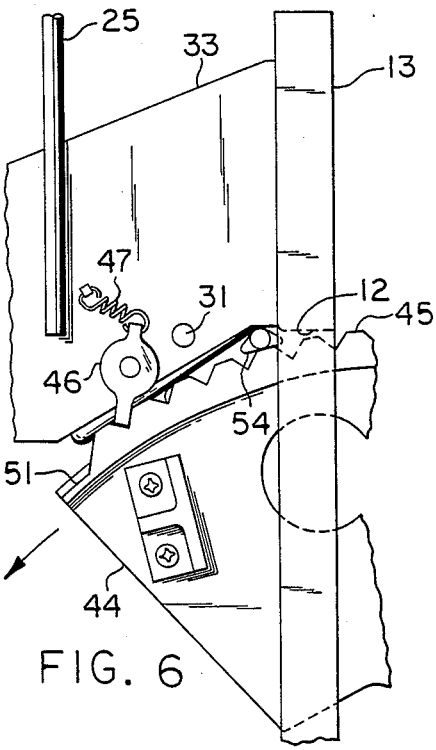
FIG. 6

ARTICLE-DISPENSING ASSEMBLY FOR A VENDING MACHINE

BACKGROUND OF THE INVENTION

This invention relates generally to an article-dispensing assembly for a vending machine, and more particularly to the vending of articles such as cans by the opening and closing of doors associated with a particular article to be dispensed.

The heretofore conventional vending machines for dispensing a plurality of items including cans are large free-standing units utilizing complicated dispensing mechanisms. These machines drop one article from a plurality of stacks into a single open dispensing compartment.

SUMMARY OF THE INVENTION

The present article-dispensing assembly is particularly adapted for a relatively small machine that can stand on a counter or can be wall-mounted. This vending machine is adapted to deliver one article from each stack of articles by the use of a delivery door associated with each particular article to be dispensed.

In the present article-dispensing assembly, a door is movably mounted on a plate and is adapted to open and close an opening provided in the plate. The door includes a shelf extending inwardly of the opening that provides a bin for holding an article to be dispensed. A control means is movable to a first position to allow transfer of an article from a feed means to the bin, and movable to a second position to block transfer of an article from the feed means to the bin. Selectively interconnecting the control means and the door is an operating means to allow loading of the bin when the door is in its closed position, and to preclude loading of the bin when the door is moved from its closed position.

In another aspect of the article-dispensing assembly, the control means includes a pivotally mounted cradle, the cradle having a rod extending transversely between the feed means and the door bin. The operating means is operatively connected to the cradle and tends to hold the transverse rod in a first position to allow transfer of an article from the feed means to the bin. A resilient means is connected to the cradle, and tends to urge the transverse rod toward a second position to preclude transfer of an article from the feed means to the bin.

In another aspect of the article-dispensing assembly, the operating means includes a sidewall on the door having a peripheral ledge and a peripheral recess leading to the ledge. The control means includes a lateral projection selectively engageable with the seating on the peripheral ledge to hold the control means in the first position to allow transfer of an article from the feed means when the door is closed, the lateral projection unseating from the ledge and moving into the peripheral recess to move the control means in the second position to preclude transfer of an article from the feed means when the door is moved from the closed position.

In still another aspect of the article-dispensing assembly, a resilient means is connected to the cradle and tends to maintain the lateral projection seated on the ledge, and tends to urge the rod toward its second position when the projection is unseated from the ledge when the door is moved from the closed position.

One aspect of the article-dispensing assembly is that the operating means interconnecting the control means and the door preclude manual actuation of the control means to the first position when the door is moved from the closed position.

Another aspect of the article-dispensing assembly is provided in that the operating means includes a sidewall on the door having a peripheral margin, and a pad is provided on the control means that selectively engages the peripheral margin to preclude movement of the control means from the second position when the door is moved from the closed position.

Still another aspect of the article-dispensing assembly is provided in that the operating means interconnecting the control means and the door includes a sidewall on the door having a peripheral margin, the peripheral margin being provided with ratchet teeth, and a pivotally mounted, double-acting pawl operatively engaging the teeth for assuring door movement to either a fully opened or fully closed position before reversal to the other position.

One aspect of the article-dispensing assembly is provided by a plurality of door-openings, and a plurality of doors mounted on the plate adapted to open and close the door openings, each door having a bin. A plurality of feed means are provided for feeding articles to the door bin. There is a control means for each door, and the operating means selectively interconnects the control means for each door and the associated door.

BRIEF DESCRIPTION OF THE DRAWINGS

FIG. 4 is a side elevational view similar to FIG. 2, illustrating the door in a partly opened position;

FIG. 5 is a fragmentary view of the door assembly of FIG. 4, showing the door in a fully opened position;

FIG. 6 is a fragmentary view of the door assembly of FIG. 4, illustrating the door being moved toward a closed position;

FIG. 7 is a fragmentary, cross-sectional view taken on line 7—7 of FIG. 4.

DESCRIPTION OF THE PREFERRED EMBODIMENT

Figure 1:
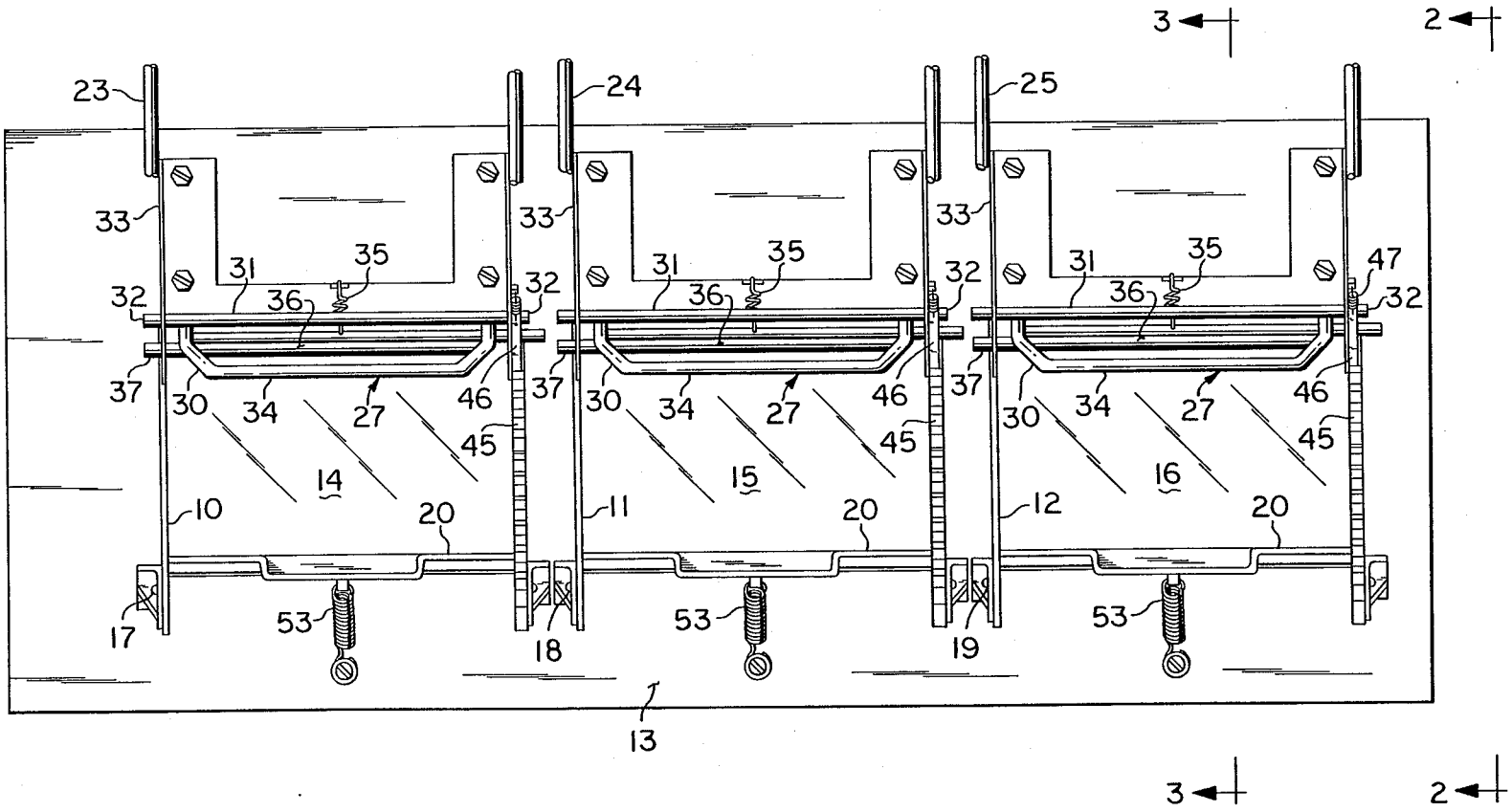
FIG. 1 is a rear elevational view of the article-dispensing assembly.

Referring now by characters of reference to the drawings, and first to FIG. 1, it will be understood that the article-dispensing assembly for the venting machine includes a plurality, a total of three in the embodiment disclosed of door openings 10, 11 and 12 formed in a front vending machine plate 13, the openings 10–12 being disposed in spaced horizontal alignment. A plurality of doors 14,15 and 16 are provided, one door for each of the openings 10–12 respectively. Each of these doors 14–16 is movably or hingedly mounted to the front plate 13 below its associated door opening 10–12 respectively by a hinge connection 17, 18 and 19 respectively. Each of the door 14–16 is movable selectively to a first closed position to close its associated opening 10–12 respectively, and to a second open position to open its associated opening 10–12 respectively.

Each of the doors 14–16 includes a shelf 20 extending inwardly of its associated opening 10–12 respectively, the shelf 20 cooperating with the rear face of the door 14–16 to provide a bin for holding an article, such as a cylindrical can, to be dispensed. As is best seen in FIG. 3, each door includes a window opening 21 covered by a transparent panel 22 to enable one to view the article to be dispensed and being held in the bin provided by the door 16.

A feed means is provided for feeding articles to each of the bins. The feed means includes a conventional serpentine rack 23, 24 and 25 associated with each of the door openings 10–12 respectively, and extending upwardly therefrom. Each of the racks 23–25 is adapted to retain a plurality of articles, and to feed under gravity such articles in sequence one by one into the bin of the associated door 14–16 respectively. As is shown in FIG. 3, the bottom of each rack 23–25 includes an inclined ledge 26 on which the lowermost article in the rack seats and is guided into the bin of the associated door when the door is fully closed as will be later explained.

Figure 3:
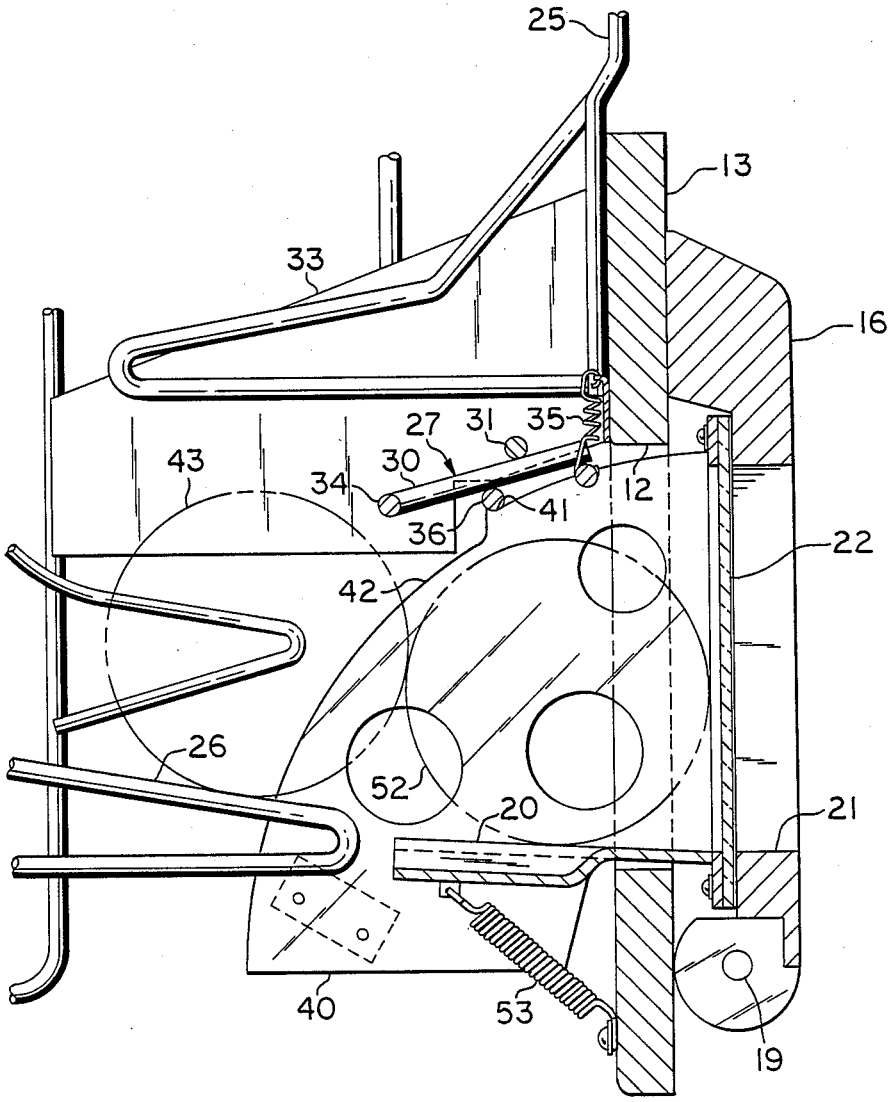
FIG. 3 is a fragmentary view, partly in cross-section, of the opposite side of the door assembly of FIG. 2 as taken on line 3—3 of FIG. 1.
Figure 8:
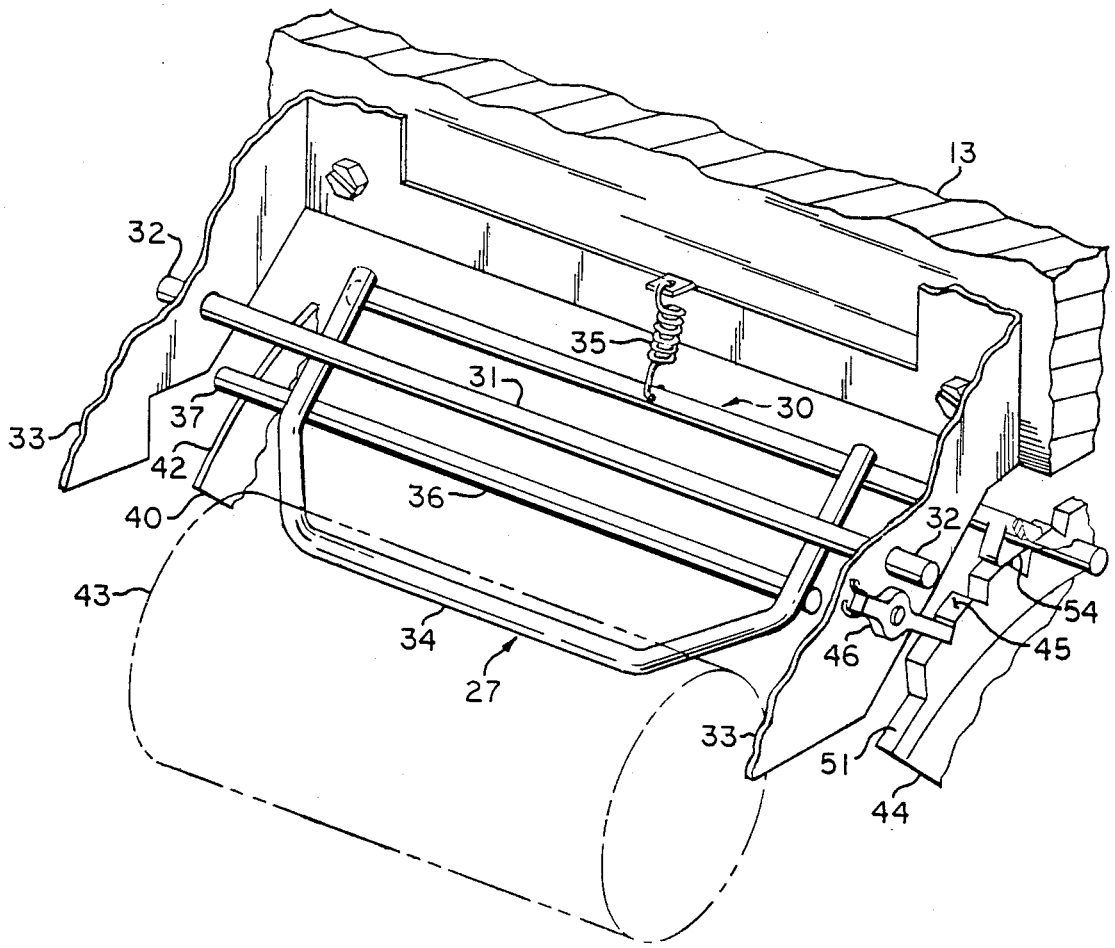
FIG. 8 is an enlarged perspective view illustrating the cradle and mounting thereof.

A control means generally indicated by 27 is movable to a first position as illustrated in FIG. 3 when the door 16 is fully closed to allow transfer of an article from the rack ledge 26 to the bin of the door 16, and is movable to a second position as illustrated in FIG. 4 when the door 16 is moved from its first closed position in a direction toward its second open position to block transfer of an article seated on the rack ledge 26.

More particularly, the control means 27 includes a cradle 30 having a transverse rod 31, and having sides 32 pivoted on a pivot axis in opposed, laterally spaced brackets 33 extending rearwardly from and attached to the rear face of the plate 13. The cradle 30 further includes another transverse rod 34 at one side of the pivot axis, the rod 34 extending between the feed means 25 and the door bin, and adapted to engage and hold the article seated on the rack ledge 26 and preclude transfer of the article to the door pin when the door 16 is fully closed. Connected to the cradle 30 is a tension spring 35, constituting a resilient means, that tends to pivot the cradle 30 and urge the transverse rod 34 toward its second position into the path of the article to preclude transfer from the feed 25.

The control means 27 further includes another transverse rod 36 having a lateral projection 37 at one side, the purpose of which will be explained upon later detailed description of parts.

An operating means selectively interconnects the control means and each door 14–16 to allow loading of the door bin when the door 14–16 is in its first closed position, and to preclude loading of the bin when the door 14–16 is moved from its first closed position. This operating means is operatively connected to the cradle 27 associated with each door 14–16, and tends to hold the transverse rod 34 in its first position out of the path of the articles retained on the rack ledge 26 to allow transfer from the rack ledge 26.

More particularly, the operating means includes a sidewall 40 on each of the doors 14–16 extending inwardly of the associated opening 10–12 respectively, and cooperating with the associated door and door shelf 20 to form the door bin. The sidewall 40 on the door 16, for example, includes a peripheral ledge 41, and an adjacent peripheral curvilinear recess 42 leading to the ledge 41. The lateral projection 37 of the cradle rod 36 is selectively engageable with and seats on the peripheral ledge 41, as is illustrated in FIG. 3, to hold the cradle 30 with its transverse rod 34 in the first position out of the path of the article 43 seated on the rack ledge 26 to allow transfer of the article 43 to the associated door bin when the door 16 is closed. When the door 16 is moved from the closed position, the lateral projection 37 of transverse rod 36 is unseated from the peripheral ledge 41, and moves into and along the peripheral recess 42, thereby allowing pivotal movement of the cradle 30 so that the transverse rod 34 is located in its second position in the path of the article 43 to preclude transfer of the article 43 from the rack ledge 26.

In addition, the operating means interconnecting the control means and each door 14–16 includes another opposed sidewall 44 that also cooperates with the sidewall 40 and the shelf 20 of the associated door to define the door bin. Each sidewall 44 is provided with a peripheral curvilinear margin having a plurality of ratchet teeth 45. Pivotally mounted on the adjacent bracket 33 is a double-acting pawl 46 operatively engaging the ratchet teeth 45 for assuring door movement to either a fully open or fully closed position before reversal of the door to the other position. The pawl 46 is operatively connected to the bracket 33 by a spring 47, constituting a resilient means, the spring 47 tending to urge the pawl 46 into the neutral position shown in FIG. 2.

Figure 2:
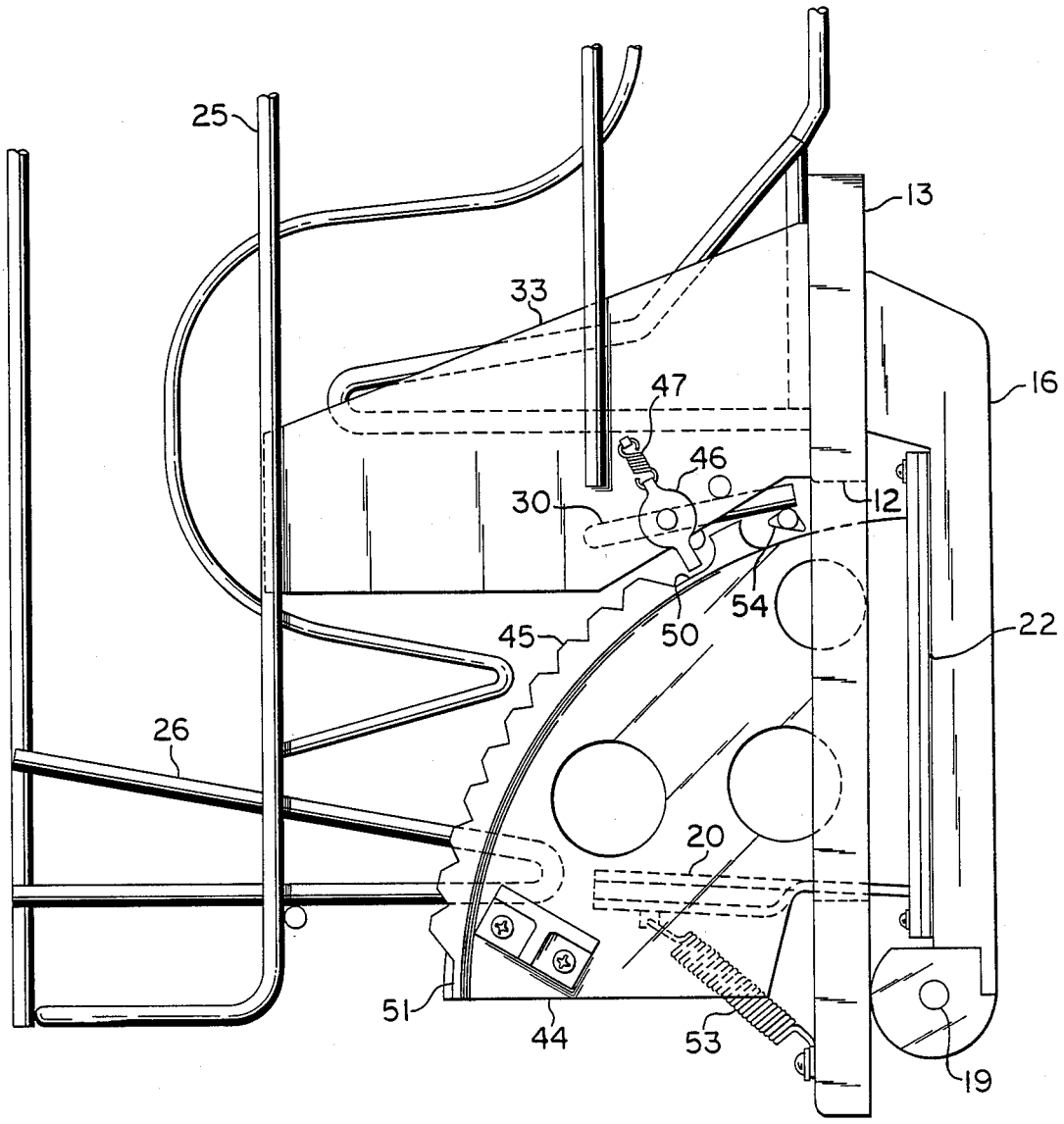
FIG. 2 is a fragmentary side elevational view of one side of a door assembly taken on line 2—2 of FIG. 1.

When each door 14–16 is located in its first closed position, as for example door 16 in FIG. 2, the pawl 46 is located in its neutral position to a dwell 50 provided in the peripheral margin. As the door 16 is moved from its first closed position as shown in FIG. 4, the pawl 46 is pivotally moved against spring loading into engagement with one side of the ratchet teeth 45 to preclude movement of the door 16 in a direction toward its first closed position.

Again, when the door 16 is in its fully opened position as illustrated in FIG. 5, the pawl 46 is again disposed in its neutral position and located in another dwell 51 formed in the peripheral margin.

The weight of the article 52 retained in the bin of the opened door 16 tends to hold the door 16 in its open position against the loading of the tension spring 53. When the user removes the dispensed article 52, the spring 53 will automatically move the door 16 from its second open position toward and to its first closed position. As the door 16 moves toward the closed position, the pawl 46 is pivoted in the opposite direction against the loading of its spring 47 to engage the opposite side of ratchet teeth 45 as disclosed in FIG. 6, thereby precluding the door 16 from being reversed and moved to its open position until the door 16 has been fully closed.

The operating means interconnecting the control means and each door 14–16 precludes manual actuation of the control means to the first position that would permit transfer of the article 43 in the racks into the door bin when the door is moved from its closed position. For example, a pad 54 is carried by the cradle 30 and moves over the top of the ratchet teeth 45 in slightly spaced relation as the door 16 is moved from its closed position to its open position. If the user attempts to reach in and tilt the cradle 30 to the position shown in FIG. 4 to the position shown in FIG. 3 in an attempt to deliver another article into the door bin, the pad 54 engages the top of the ratchet teeth 45 and precludes such cradle movement, and thereby precludes unauthorized and unwanted transfer of the article 43 seated on the rack ledge 26 into the door bin.

It is thought that the operation and functional advantages of this article-dispensing assembly have become fully apparent from the foregoing detailed description of parts, but for completeness of disclosure, the operation of each door will be described. It will be assumed that each door 14–16 is in its first closed position, and that the serpentine racks are filled with articles such as cans to be dispensed. In the closed positions of the doors 14–16, the associated cradle 30 for each of these doors 14–16 is located in its first position so that the transverse rod 34 is raised to a first position so as not to block the transfer of the article 43 seated on the rack ledge 26 into the associated door bin. Therefore, the article to be dispensed upon opening of any particular door is located in the door bin, and another article 43 is seated on the rack ledge 26 ready to be dispensed upon subsequent operation.

As described above, upon opening movement of any of the doors 14–16, the lateral projection 37 of the cradle 30 unseats from the peripheral ledge 41 and moves into the curvilinear peripheral recess 42, thereby allowing the cradle 30 to pivot under the loading of spring 35 to its second position so that the transverse rod 34 moves into blocking relation between the feed means and door bin, the rod 34 engaging the article 43 seated on the rack ledge 26 and preventing movement therefrom.

Further, the pawl 46 engages the ratchet teeth 45 and assures movement of the door 14 to its fully opened position before such door 14 can be closed.

The weight of the article 52 to be dispensed and held in the door bin overcomes the loading of the door spring 53, and holds the door 14 in its open position until the user removes the article 52 from the door bin. When the article 52 is removed, the spring 53 acts to move the door 14 from its open position to its closed position.

Again, it will be understood that as each door 14–16 is moved toward its closed position, the pawl 46 engages the ratchet teeth 45, and precludes reverse movement of the door toward its open position until such door is moved to its fully closed position. Further, the lateral projection 32 of the associated cradle 30 moves along the peripheral recess 42 and seats on its holding peripheral ledge 41 when the door is located in its fully closed position. Upon such occurance, the cradle 30 of the associated door is moved to its first position so that the transverse rod 34 is raised out of blocking engagement with the article 43 seated on the rack ledge 26, thereby allowing the article 43 to move into the door bin for subsequent dispensing by the door. Another article will then fall under gravity along the serpentine rack and on the rack ledge 26.

To dispense the article held in the bin of door 15, the door 15 is moved from its closed position to its open position. When the door 15 is in its fully open position, and the article 52 is removed, the door 15 will move back to its closed position.

We claim as our invention:

1. An article-dispensing assembly, comprising:

(a) a plate provided with an opening, (b) a door having a lower portion hingedly attached to the plate, the door being movable selectively to a first position to close the opening and to a second position to open the opening, and the door including a shelf extending inwardly of the opening and providing a bin for holding an article to be dispensed, (c) feed means for feeding articles to the bin, (d) a control means disposed above the hinge and having an article-engageable means movable to a first position to allow transfer of an article from the feed means to the bin, and movable to a second position to engage an article to block transfer of an article from the feed means to the bin, and (e) operating means connected to the door and engageable by the control means to allow the article-engageable means to move into the second position substantially when the door is moved from its first closed position and maintain said engagement until the door is substantially returned to its first position, the movement of the article-engageable means being disproportionate relative to the movement of the door.

2. An article-dispensing assembly as defined in claim 1, in which:

(f) the control means disposed above the hinge includes a pivotally mounted article-engageable means movable to a first position out of the path of the article to allow transfer from the feed means, and movable to a second position into the path of the article to preclude transfer from the feed means.

3. An article-dispensing assembly as defined in claim 2, in which:

(g) a resilient means is connected to the article-engageable means and tends to urge said means toward its second position, and (h) the operating means is operatively connected to the article-engageable means and tends to hold said means in the first position when the door is disposed in its first closed position.

4. An article-dispensing assembly as defined in claim 1, in which:

(f) the control means includes a single cradle having:

1. sides pivotally mounted on a pivot axis, and
2. said article-engageable means at one side of the pivot axis extending transversely between the feed means and the door bin, (g) the operating means is operatively connected to the cradle, and tends to hold the article-engageable means in the first position out of the path of the article to allow transfer from the feed means, and (h) resilient means is connected to the cradle, and tends to urge the article-engageable means toward the second position into the path of the article to preclude transfer from the feed means.

5. An article-dispensing assembly as defined in claim 1, in which:

(f) the plate includes laterally spaced brackets, and (g) the control means is operatively pivotally mounted between said brackets.

6. An article-dispensing assembly as defined in claim 1, in which:

(f) the operating means includes a margin engageable by the control means and configurated to provide the disproportionate movement of said article-engageable means relative to said door.

7. An article-dispensing assembly, comprising:

(a) a plate provided with an opening, (b) a door movably mounted on the plate, the door being movable selectively to a first position to close the opening and to a second position to open the opening, and the door including a shelf extending inwardly of the opening and providing a bin for holding an article to be dispensed, (c) feed means for feeding articles to the bin, (d) a control means movable to a first position to allow transfer of an article from the feed means to the bin, and movable to a second position to block transfer of an article from the feed means to the bin, (e) operating means selectively interconnecting the control means and door to allow loading of the bin when the door is in its first closed position and to preclude loading of the bin when the door is moved from its first closed position, (f) the operating means including a sidewall on the door having a peripheral ledge and a peripheral recess leading to the ledge, and (g) the control means including a lateral projection selectively engageable with and seating on the peripheral ledge to hold the control means in the first position out of the path of the article to allow transfer from the feed means when the door is closed, the lateral projection unseating from the ledge and moving into the peripheral recess to urge the control means in the second position into the path of the article to preclude transfer from the feed means when the door is moved from the closed position.

8. An article-dispensing assembly as defined in claim 7, in which:

(h) resilient means is connected to the rod and tends to maintain the lateral projection seated on the ledge, and tends to urge the rod toward its second position when the projection is unseated from the ledge when the door is moved from the closed position.

9. An article-dispensing assembly as defined in claim 8, in which:

(i) the control means includes a cradle having:

1. sides pivotally mounted on a pivot axis,
2. a rod at one side of the pivot axis extending transversely between the feed means and the door bin, and
3. the lateral projection extending outwardly and located at the same side of the pivot axis as the rod, and (j) the resilient means is connected to the cradle at the other side of the pivot axis.

10. An article-dispensing assembly, comprising:

(a) a plate provided with an opening, (b) a door having a lower portion hingedly attached to the plate, the door being movable selectively to a first position to close the opening and to a second position to open the opening, and the door including a shelf extending inwardly of the opening and providing a bin for holding an article to be dispensed, (c) feed means for feeding articles to the bin, (d) a control means disposed above the hinge and movable to a first position to allow transfer of an article from the feed means to the bin, and movable to a second position to block transfer of an article from the feed means to the bin, (e) operating means selectively interconnecting the control means and door to allow loading of the bin when the door is in its first closed position and to preclude loading of the bin when the door is moved from its first closed position, (f) the operating means including a sidewall on the door having a peripheral margin, and (g) means on the control means selectively engaging with the peripheral margin to preclude movement of the control means from the second position when the door is moved from the closed position.

11. An article-dispensing assembly, comprising:

(a) a plate provided with an opening, (b) a door movably mounted on the plate, the door being movable selectively to a first position to close the opening and to a second position to open the opening, and the door including a shelf extending inwardly of the opening and providing a bin for holding an article to be dispensed, (c) feed means for feeding articles to the bin, (d) a control means movable to a first position to allow transfer of an article from the feed means to the bin, and movable to a second position to block transfer of an article from the feed means to the bin, and (e) operating means selectively interconnecting the control means and door to allow loading of the bin when the door is in its first closed position and to preclude loading of the bin when the door is moved from its first closed position, (f) the operating means interconnecting the control means and door precluding manual actuation of the control means to the first position when the door is moved from the closed position, and (g) the operating means including a sidewall on the door having a peripheral margin, and (h) a pad on the control means selectively engageable with the peripheral margin to preclude movement of the control means from the second position when the door is moved from the closed position.

12. An article-dispensing assembly, comprising:

(a) a plate provided with an opening, (b) a door movably mounted on the plate, the door being movable selectively to a first position to close the opening and to a second position to open the opening, and the door including a shelf extending inwardly of the opening and providing a bin for holding an article to be dispensed, (c) feed means for feeding articles to the bin, (d) a control means movable to a first position to allow transfer of an article from the feed means to the bin, and movable to a second position to block transfer of an article from the feed means to the bin, (e) operating means selectively interconnecting the control means and door to allow loading of the bin when the door is in its first closed position and to preclude loading of the bin when the door is moved from its first closed position, (f) the control means including a cradle having:

1. sides pivotally mounted on a pivot axis,
2. a rod at one side of the pivot axis extending transversely between the feed means and the door bin, and
3. a pad at the other side of the pivot axis, and (g) the operating means including a sidewall on the door having a peripheral margin, the pad selectively engaging the peripheral margin to exclude movement of the rod from the second position when the door is moved from the closed position.

13. An article-dispensing assembly, comprising:

(a) a plate provided with an opening, (b) a door having a lower portion hingedly attached to the plate, the door being movable selectively to a first position to close the opening and to a second position to open the opening, and the door including a shelf extending inwardly of the opening and providing a bin for holding an article to be dispensed, (c) feed means for feeding articles to the bin, (d) a control means disposed above the hinge and movable to a first position to allow transfer of an article from the feed means to the bin, and movable to a second position to block transfer of an article from the feed means to the bin, (e) operating means selectively interconnecting the control means and door to allow loading of the bin when the door is in its first closed position and to preclude loading of the bin when the door is moved from its first closed position, (f) the operating means interconnecting the control means and the door including:

1. a sidewall on the door having a peripheral margin, the peripheral margin being provided with ratchet teeth, and
2. a pivotally mounted, double-acting pawl operatively engaging the teeth for assuring door movement to either a fully open or fully closed position before reversal to the other position, and (g) the control means including a means selectively engageable with the ratchet teeth to preclude movement of the rod from the second position when the door is moved from the closed position.

14. An article-dispensing assembly, comprising:

(a) a plate provided with an opening, (b) a door movably mounted on the plate, the door being movable selectively to a first position to close the opening and to a second position to open the opening, and the door including a shelf extending inwardly of the opening and providing a bin for holding an article to be dispensed, (c) feed means for feeding articles to the bin, (d) a control means movable to a first position to allow transfer of an article from the feed means to the bin, and movable to a second position to block transfer of an article from the feed means to the bin, (e) operating means selectively interconnecting the control means and door to allow loading of the bin when the door is in its first closed position and to preclude loading of the bin when the door is moved from its first closed position, (f) the operating means interconnecting the control means and the door including:

1. a sidewall on the door having a peripheral margin, the peripheral margin being provided with ratchet teeth, and
2. a pivotally mounted, double-acting pawl operatively engaging the teeth for assuring door movement to either a fully open or fully closed position before reversal to the other position, and (g) the control means including a pad selectively engageable with the ratchet teeth to preclude movement of the rod from the second position when the door is moved from the closed position.

15. An article-dispensing assembly, comprising:

(a) a plate provided with an opening, (b) a door movably mounted on the plate, the door being movable selectively to a first position to close the opening and to a second position to open the opening, and the door including a shelf extending inwardly of the opening and providing a bin for holding an article to be dispensed, (c) feed means for feeding articles to the bin, (d) a control means movable to a first position to allow transfer of an article from the feed means to the bin, and movable to a second position to block transfer of an article from the feed means to the bin, (e) operating means selectively interconnecting the control means and door to allow loading of the bin when the door is in its first closed position and to preclude loading of the bin when the door is moved from its first closed position, (f) the operating means including:

1. a sidewall on the door having a peripheral ledge and a peripheral recess leading to the ledge, and
2. a sidewall on the door having a peripheral margin, and (g) the control means including:

1. a pad selectively engageable with the peripheral margin to preclude movement of the control means from the second position when the door is moved from the closed position,
2. a cradle having sides pivotally mounted on a pivot axis,
3. a rod at one side of the pivot axis extending transversely between the feed means and the door bin, and
4. a lateral projection selectively engageable with and seating on the peripheral ledge to hold the control means in the first position out of the path of the article to allow transfer from the feed means when the door is closed, the lateral projection unseating from the ledge and moving into the peripheral recess to move the control means in the second position into the path of the article to preclude transfer of the feed means when the door is moved from the closed position, and (h) resilient means being connected to the rod and tending to maintain the lateral projection seated on the ledge, and tending to urge the rod toward its second position when the projection is unseated from the ledge when the door is moved from the closed position.

16. An article-dispensing assembly as defined in claim 15, in which:

(i) the operating means interconnecting the control means and the door includes:

1. a sidewall on the door having a peripheral margin, the peripheral margin being provided with ratchet teeth, and
2. a pivotally mounted, double-acting pawl operatively engaging the teeth for assuring door movement to either a fully open or fully closed position before reversal to the other position, and (j) the control means includes a pad selectively engageable with the ratchet teeth to preclude movement of the rod from the second position when the door is moved from the closed position.

17. An article-dispensing assembly, comprising:

(a) a plate provided with an opening, (b) a door having a lower portion hingedly attached to the plate, the door being movable selectively to a first position to close the opening and to a second position to open the opening, and the door including a shelf extending inwardly of the opening and providing a bin for holding an article to be dispensed, (c) feed means for feeding articles to the bin, (d) a control means disposed above the hinge and movable to a first position to allow transfer of an article from the feed means to the bin, and movable to a second position to block transfer of an article from the feed means to the bin, (e) operating means selectively interconnecting the control means and door to allow loading of the bin when the door is in its first closed position and to preclude loading of the bin when the door is moved from its first closed position, (f) the operating means including means on the door having a ledge and a recess leading to the ledge, and (g) the control means including means selectively engageable with and seating on the ledge to hold the control means in the first position out of the path of the article to allow transfer from the feed means when the door is closed, said means unseating from the ledge and moving into the recess to urge the control means in the second position into the path of the article to preclude transfer from the feed means when the door is moved from the closed position.

18. An article-dispensing assembly, comprising:

(a) a plate provided with an opening, (b) a door having a lower portion hingedly attached to the plate, the door being movable selectively to a first position to close the opening and to a second position to open the opening, and the door including a shelf extending inwardly of the opening and providing a bin for holding an article to be dispensed, (c) feed means for feeding articles to the bin, (d) a control means disposed above the hinge and movable to a first position to allow transfer of an article from the feed means to the bin, and movable to a second position to block transfer of an article from the feed means to the bin, (e) operating means selectively interconnecting the control means and door to allow loading of the bin when the door is in its first closed position and to preclude loading of the bin when the door is moved from its first closed position, (f) the operating means including means on the door having a ledge and a recess leading to the ledge, (g) the plate including laterally spaced brackets, and (h) the control means including a cradle having:

1. sides pivotally mounted on a pivot axis between the spaced brackets, and
2. article-engageable means on one side of the pivot axis, and
3. means selectively engageable with and seating on the ledge to hold the cradle in the first position out of the path of the article to allow transfer from the feed means when the door is closed, said means unseating from the ledge and moving into the recess to urge the cradle in the second position into the path of the article to preclude transfer from the feed means when the door is moved from the closed position.

19. An article-dispensing assembly as defined in claim 18, in which:

(i) a resilient means is connected to the cradle at the other side of the cradle pivot axis and tends to urge the cradle toward its second position.

* * * * *